US010100473B1

(12) United States Patent
Van Egmond

(10) Patent No.: US 10,100,473 B1
(45) Date of Patent: Oct. 16, 2018

(54) MODULAR TRAFFIC DIRECTOR

(71) Applicant: Kurt Van Egmond, Manchester, NH (US)

(72) Inventor: Kurt Van Egmond, Manchester, NH (US)

( * ) Notice: Subject to any disclaimer, the term of this patent is extended or adjusted under 35 U.S.C. 154(b) by 203 days.

(21) Appl. No.: 15/150,940

(22) Filed: May 10, 2016

(51) Int. Cl.

| | |
|---|---|
| ***E01F 9/654*** | (2016.01) |
| ***E01F 9/70*** | (2016.01) |
| ***E01F 9/619*** | (2016.01) |
| ***E01F 9/692*** | (2016.01) |
| ***E01F 9/627*** | (2016.01) |

(52) U.S. Cl.
CPC ..... *E01F 9/619* (2016.02); *E01F 9/629* (2016.02); *E01F 9/654* (2016.02); *E01F 9/692* (2016.02); *E01F 9/70* (2016.02)

(58) Field of Classification Search
CPC . E01F 9/629; E01F 9/654; E01F 9/688; E01F 9/692; E01F 9/70
USPC ..... 116/63 C, 63 P, 63 R
See application file for complete search history.

(56) References Cited

U.S. PATENT DOCUMENTS

| | | | | |
|---|---|---|---|---|
| 5,560,732 | A * | 10/1996 | Kulp et al. | E01F 9/688 116/63 P |
| 5,639,179 | A | 6/1997 | Jensen | |
| 6,182,600 | B1 * | 2/2001 | Brown et al. | E01F 9/688 116/63 C |
| 6,202,587 | B1 * | 3/2001 | Stewart | E01F 13/022 116/205 |
| D462,630 | S | 9/2002 | Jeon | |
| 6,656,319 | B1 * | 12/2003 | Boyd et al. | C09J 5/02 156/212 |
| 6,769,380 | B1 | 8/2004 | Carvajalino | |
| 6,948,446 | B2 | 9/2005 | Greves | |
| 7,819,605 | B2 | 10/2010 | Heald | |
| 8,154,424 | B2 | 4/2012 | Selevan | |
| 8,734,048 | B1 | 5/2014 | Driskell | |
| 2005/0220537 | A1 | 10/2005 | Bentley | |
| 2007/0126600 | A1 * | 6/2007 | Huang | E01F 9/65 340/908 |
| 2012/0234228 | A1 | 9/2012 | Kuo | |
| 2015/0332617 | A1 * | 11/2015 | Cuttill et al. | E01F 9/688 248/237 |

FOREIGN PATENT DOCUMENTS

WO 2009091386 A2 7/2009

* cited by examiner

*Primary Examiner* — R. A. Smith

(57) ABSTRACT

The modular traffic director is a temporary traffic indicator that is adapted to direct traffic through construction zones. The modular traffic director is a signaling device that is designed for visibility and that is designed with a plurality of conspicuous cylinders that project perpendicularly from the ground such that the modular traffic director is readily visible to traffic. The modular traffic director is stackable. The modular traffic director comprises a base and a plurality of conspicuous cylinders.

4 Claims, 3 Drawing Sheets

MODULAR TRAFFIC DIRECTOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of construction of roads, railways and bridges and arrangements for road signs and traffic signals, more specifically, a portable and freestanding marking post.

SUMMARY OF INVENTION

The modular traffic director is a temporary traffic indicator that is adapted to direct traffic through construction zones. The modular traffic director is a signaling device that is designed for visibility and that is designed with a plurality of conspicuous cylinders that project perpendicularly from the ground such that the modular traffic director is readily visible to traffic. The modular traffic director is stackable.

These together with additional objects, features and advantages of the modular traffic director will be readily apparent to those of ordinary skill in the art upon reading the following detailed description of the presently preferred, but nonetheless illustrative, embodiments when taken in conjunction with the accompanying drawings.

In this respect, before explaining the current embodiments of the modular traffic director in detail, it is to be understood that the modular traffic director is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the modular traffic director.

It is therefore important that the claims be regarded as including such equivalent construction insofar as they do not depart from the spirit and scope of the modular traffic director. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
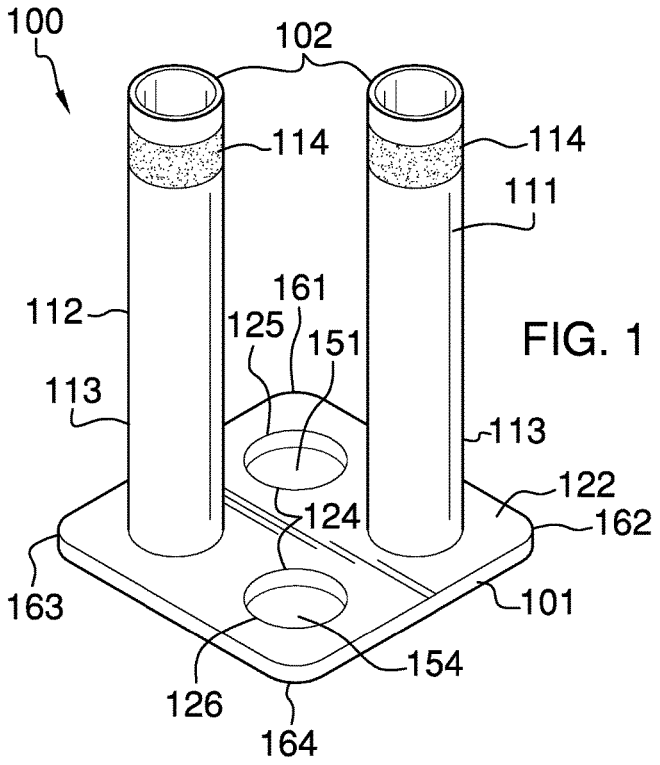
FIG. 1 is a perspective view of an embodiment of the disclosure.
Figure 2:
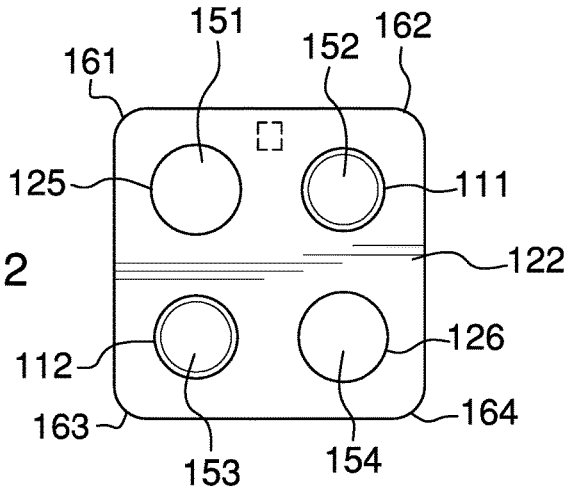
FIG. 2 is a top view of an embodiment of the disclosure.
Figure 3:
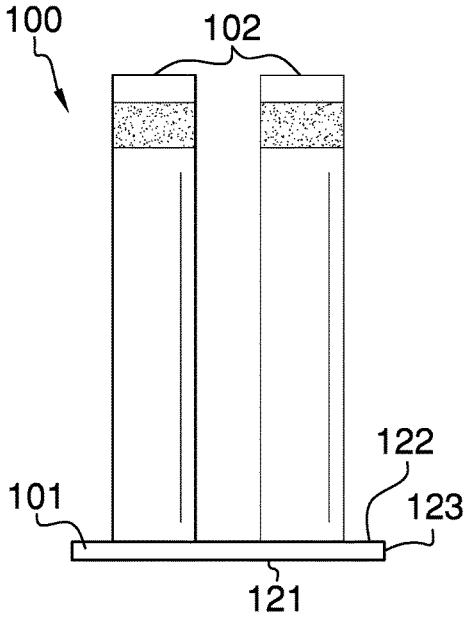
FIG. 3 is a front view of an embodiment of the disclosure.
Figure 4:
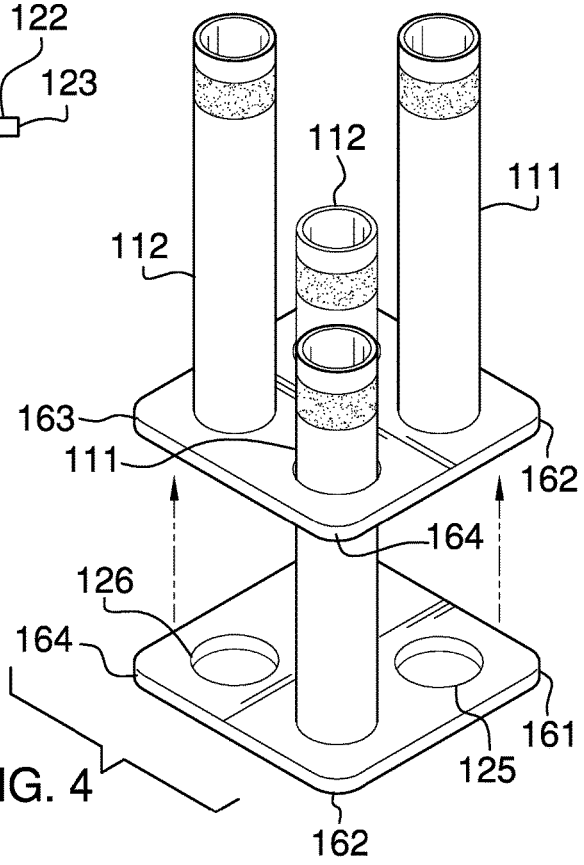
FIG. 4 is a detail view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The modular traffic director 100 (hereinafter invention) comprises a base 101 and a plurality of conspicuous cylinders 102. The invention 100 is a temporary traffic 131 indicator that is adapted to direct traffic 131 through construction zones. The invention 100 is portable. The invention 100 is a signaling device that is designed for visibility. The invention 100 is designed with a plurality of conspicuous cylinders 102 that project perpendicularly from the ground 132 such that the invention 100 is readily visible to traffic 131. The invention 100 is stackable.

The base 101 comprises a plate 123 and a plurality of holes 124. The plate 123 is a rectangular structure that is formed in the shape of a rectangular block with the appearance of a plate. The plate 123 is further defined with a first surface 121 and a second surface 122. The plate 123 is further defined with a first corner 161, a second corner 162, a third corner 163, and a fourth corner 164. The first surface 121 is the surface of the plate 123 that is proximal to the ground 132 when the invention 100 is in use. The second surface 122 is the surface of the plate 123 that is distal from the first surface 121. The second surface 122 is further defined by four points that are referred to as a first center 151, a second center 152, a third center 153, and a fourth center 154. The location of the first center 151, the second center 152, the third center 153, the fourth center 154 is defined by the corner of a conceptual rectangle that can be drawn on the second surface 122 of the plate 123 such: 1) that the center 150 of the conceptual rectangle overlays the center 150 of the second surface 122 of the plate 123; 2) the span of the line from the first center 151 to the first corner 161 is equal to the span of the distance from the second center 152 to the second corner 162; 3) the span of the line from the second center 152 to the second corner 162 is equal to the span of the distance from the third center 153 to the third corner 163; 4) the span of the line from the third center 153 to the third corner 163 is equal to the span of the distance from the fourth center 154 to the fourth corner 164; and, 5) the span of the line from the fourth center 154 to the fourth corner 164 is equal to the span of the distance from the first center 151 to the first corner 161.

The plurality of holes 124 further comprises a first hole 125 and a second hole 126. The first hole 125 is formed as a circular aperture through the plate 123 from the first surface 121 to the second surface 122. The second hole 126 is formed as a circular aperture through the plate 123 from the first surface 121 to the second surface 122. As shown most clearly in FIG. 2, the center of the first hole 125 is located at the first center 151 and the center of the second hole 126 is located at the fourth center 154.

Each of the plurality of conspicuous cylinders 102 further comprises a tube 113 and one or more reflective bands 114. Each tube 113 is a structure that projects perpendicularly from the second surface 122 of the plate 123. The shape of the tube 113 is less important than the tube 113 be attached to the second surface 122 of the plate 123 in the manner of a cantilever with one free end. Each tube 113 is formed from an elastomeric material that will yield when struck with force by an object. This is done to minimize damage to vehicles should the invention 100 be struck. Each of the plurality of conspicuous cylinders 102 has attached to its exterior one or more reflective bands 114. Each of the one or more reflective bands 114 acts as a retroreflector when the light of a vehicle falls upon each of the one or more reflective bands 114. The purpose of each of the one or more reflective bands 114 is to draw attention to the invention 100. The outer dimension of each of the plurality of conspicuous cylinders 102 is lesser than the inner diameter of each of the plurality of holes 124 such that the free end of each of the plurality of conspicuous cylinders 102 will fit through any hole selected from the plurality of holes 124. The plurality of conspicuous cylinders 102 further comprises a first conspicuous cylinder 111 and a second conspicuous cylinder 112. The center axis of the first conspicuous cylinder 111 is aligned with the second center 152. The center axis of the second conspicuous cylinder 112 is aligned with the third center 153.

Figure 5:
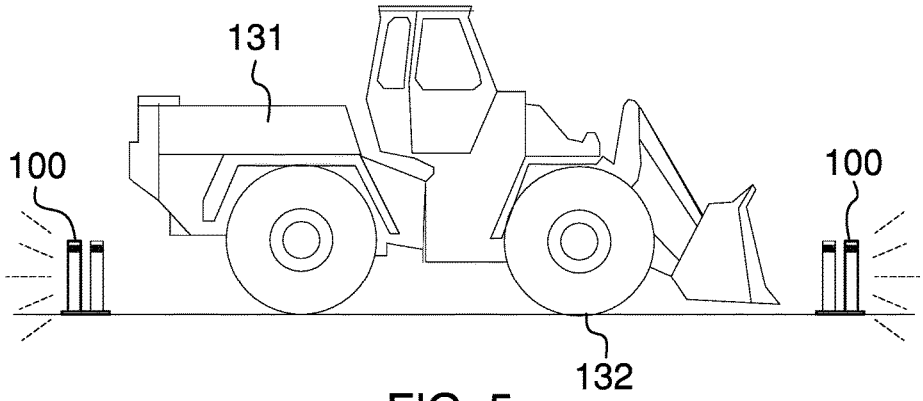
FIG. 5 is an in use view of an embodiment of the disclosure.

As shown most clearly in FIG. 5, to use the invention 100, the invention 100 is simply placed in a location where one wishes attention to be drawn. For example, in the context of the direction of vehicular traffic 131, the invention 100 is appropriately placed in positions to mark a path, mark a boundary, or draw attention to a potential hazard. When no longer required, any first instantiation of the invention 100 can be stacked on any second instantiation of the invention 100 by aligning the first center 151 of the first instantiation of the invention 100 with the second center 152 of the second instantiation of the invention 100 and aligning the fourth center 154 of the first instantiation of the invention 100 with the third center 153 of the second instantiation of the invention 100. In this position, the first instantiation of the invention 100 will stack onto the second instantiation of the invention 100.

The first potential embodiment of the disclosure is formed as single unit from molded plastic. Suitable plastic includes, but is not limited to, polyvinylchloride. The one or more reflective bands 114 are added later in the process. A readily and commercially available retroreflective tape is used to apply the one or more reflective bands 114.

The following definitions were used in this disclosure:

Cantilever: As used in this disclosure, a cantilever is a beam or other structure that projects away from an object and is supported on only one end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cylinder: As used in this disclosure, a cylinder is a geometric structure defined by two identical flat and parallel ends, also commonly referred to as bases, which are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Diameter: As used in this disclosure, a diameter of an object is a straight line segment that passes through the center of an object. The line segment of the diameter is terminated at the perimeter or boundary of the object through which the line segment of the diameter runs.

Elastic: As used in this disclosure, an elastic is a material or object that deforms when a force is applied to it and that is able to return to its original shape after the force is removed. A material that exhibits these qualities is also referred to as an elastomeric material.

Inner Diameter: As used in this disclosure, the term inner diameter is used in the same way that a plumber would refer to the inner diameter of a pipe.

Inner Dimension: As used in this disclosure, the term inner dimension describes the span from a first inside or interior surface of a container to a second inside or interior surface of a container. The term is used in much the same way that a plumber would refer to the inner diameter of a pipe.

Outer Diameter: As used in this disclosure, the term outer diameter is used in the same way that a plumber would refer to the outer diameter of a pipe.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Retroreflective Tape: As used in this disclosure, a retroreflective tape is a commercially available adhesive tape that can be attached to an object such that when light strikes the retroreflective tape the side of the retroreflective tape that is distal from the object will reflect the light as if it were a retroreflector.

Retroreflector: As used in this disclosure, a retroreflector is a device that reflects light along a vector parallel but opposite to the originating light source.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A marking post comprising:

a base and a plurality of conspicuous cylinders;

wherein the marking post is adapted for use in directing traffic;

wherein the marking post is a temporary traffic indicator;

wherein the marking post is portable;

wherein the plurality of conspicuous cylinders are attached to the base;

wherein the base comprises a plate and a plurality of holes;

wherein the plurality of holes are formed in the base;

wherein the plate is a rectangular structure;

wherein the plate is further defined with a first surface, a second surface, a first corner, a second corner, a third corner, and a fourth corner;

wherein the second surface is further defined by four points that are referred to as a first center, a second center, a third center, and a fourth center;

wherein the plurality of holes further comprises a first hole and a second hole;

wherein the first hole is a circular aperture formed through the plate from the first surface to the second surface;

wherein the second hole is a circular aperture formed through the plate from the first surface to the second surface;

wherein the center of the first hole is located at the first center;

wherein the center of the second hole is located at the fourth center;

wherein each of the plurality of conspicuous cylinders further comprises a tube and one or more reflective bands;

wherein each of the one or more reflective bands is attached to the tube;

wherein each tube is a structure that projects perpendicularly from the second surface of the plate;

wherein each tube attaches to the second surface of the plate in the manner of a cantilever;

wherein each tube is formed from an elastomeric material.

2. The marking post according to claim 1 wherein each of the one or more reflective bands is a retro-reflector.

3. The marking post according to claim 2 wherein the outer dimension of each of the plurality of conspicuous cylinders is lesser than the inner diameter of each of the plurality of holes.

4. The marking post according to claim 3 wherein the plurality of conspicuous cylinders further comprises a first conspicuous cylinder and a second conspicuous cylinder;

wherein the center axis of the first conspicuous cylinder is aligned with the second center;

wherein the center axis of the second conspicuous cylinder is aligned with the third center.

* * * * *